US006869650B2

(12) United States Patent
Burch et al.

(10) Patent No.: US 6,869,650 B2
(45) Date of Patent: Mar. 22, 2005

(54) IMAGES PRINTED ON POROUS MEDIA AND COATED WITH A THERMAL TRANSFER OVERCOAT

(75) Inventors: Eric L Burch, San Diego, CA (US); Vladek P Kasperchik, Corvallis, OR (US); Shilin Guo, San Diego, CA (US); David J Arcaro, Boise, ID (US); Gary E Hanson, Meridian, ID (US); Maximo Gayoso, Jalisco (MX); Richard J McManus, San Diego, CA (US); Dan M Weeks, Poway, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 10/167,924

(22) Filed: Jun. 11, 2002

(65) Prior Publication Data

US 2003/0228450 A1 Dec. 11, 2003

(51) Int. Cl.[7] ..... B41M 5/40

(52) U.S. Cl. ..... 428/32.52; 428/32.81; 428/32.87

(58) Field of Search ..... 428/32.52, 32.81, 428/32.87, 195, 213, 32.34

(56) References Cited

U.S. PATENT DOCUMENTS

| | | | | |
|---|---|---|---|---|
| 4,780,348 | A | 10/1988 | Yamamoto et al. | |
| 5,397,634 | A | 3/1995 | Cahill et al. | |
| 5,681,660 | A | 10/1997 | Bull et al. | |
| 6,114,027 | A | 9/2000 | Onishi et al. | |
| 6,492,005 | B1 * | 12/2002 | Ohbayashi et al. | 428/195 |

* cited by examiner

*Primary Examiner*—B. Shewareged

(57) ABSTRACT

The present invention is drawn to the thermal transfer overcoating of images printed on porous media, and methods of overcoating images printed on porous media. Upon use of the systems and methods of the present invention, a thermally coated print is generated that can comprise a porous media substrate having printed thereon a digitally produced image. The digitally produced image and the porous media substrate is thermally coated by an adhesive protective layer, wherein the adhesive protective layer has a tangent d that is greater than 1 and melt viscosity less than $1\times10^5$ Pa.·sec. as applied above its phase transition temperature. Thus, the voids in the porous media substrate can be substantially filled, and further, substantially no tags remain on the print.

24 Claims, 2 Drawing Sheets

IMAGES PRINTED ON POROUS MEDIA AND COATED WITH A THERMAL TRANSFER OVERCOAT

FIELD OF THE INVENTION

The present invention is drawn to thermal transfer overcoating of images printed on porous media, and methods of overcoating images printed on porous media.

BACKGROUND OF THE INVENTION

Computer printer technology has evolved to a point where very high resolution images can be transferred to various types of media, including paper. One particular type of printing involves the placement of small drops of a fluid ink onto a media surface in response to a digital signal. Typically, the fluid ink is placed or jetted onto the surface without physical contact between the printing device and the surface. Within this general technique, the specific method that the ink-jet ink is deposited onto the printing surface varies from system to system, and can include continuous ink deposit and drop-on-demand ink deposit.

With regard to continuous printing systems, inks used are typically based on solvents such as methyl ethyl ketone and ethanol. Essentially, continuous printing systems function as a stream of ink droplets are ejected and directed by a printer nozzle. The ink droplets are directed additionally with the assistance of an electrostatic charging device in close proximity to the nozzle. If the ink is not used on the desired printing surface, the ink is recycled for later use. With regard to drop-on-demand printing systems, the ink-jet inks are typically based upon water and glycols. Essentially, with these systems, ink droplets are propelled from a nozzle by heat or by a pressure wave such that all of the ink droplets ejected are used to form the printed image.

There are several reasons that ink-jet printing has become a popular way of recording images on various media surfaces, particularly paper. Some of these reasons include low printer noise, capability of high-speed recording, and multi-color recording. Additionally, these advantages can be obtained at a relatively low price to consumers. However, though there has been great improvement in ink-jet printing, accompanying this improvement are increased demands by consumers in this area, e.g., higher speeds, higher resolution, full color image formation, increased stability, etc. As new ink-jet inks are developed, there have been several traditional characteristics to consider when evaluating the ink in conjunction with a printing surface or substrate. Such characteristics include edge acuity and optical density of the image on the surface, dry time of the ink on the substrate, adhesion to the substrate, lack of deviation of ink droplets, presence of all dots, resistance of the ink after drying to water and other solvents, long term storage stability, and long term reliability without corrosion or nozzle clogging. Though the above list of characteristics provides a worthy goal to achieve, there are difficulties associated with satisfying all of the above characteristics. Often, the inclusion of an ink component meant to satisfy one of the above characteristics can prevent another characteristic from being met. Thus, most commercial inks for use in ink-jet printers represent a compromise in an attempt to achieve at least an adequate response in meeting all of the above listed requirements.

In general, ink-jet inks are either dye- or pigment-based inks. Dye-based ink-jet inks generally use a liquid colorant that is usually water-based to turn the media a specific color.

Because of their makeup, dye-based inks are usually not as waterproof and tend to be more affected by ultraviolet light. This results in the color changing over time, or fading. For optimum performance, this type of ink has often required that the proper media be selected in accordance with the application, thus, reducing the choice of media for printing. Conversely, pigmented inks typically use a solid colorant to achieve color. In many cases, the line quality and accuracy of plots produced by pigment-based inks are usually superior to that of dye-based inks. With pigmented inks, solid particles adhere to the surface of the substrate. Once the water in the solution has evaporated, the particles will generally not go back into the solution, and are therefore more waterproof. In addition, pigmented inks are much more ultraviolet resistant than dye-based inks, meaning that it takes much longer for noticeable fading to occur. Though pigmented inks, in some areas, exhibit superior characteristics, dyes tend to run cleaner, provide better yield, offer better particle size, and are easier to filter. Thus, dye-based inks have been more often used for common applications and have tended to be more chromatic and provide more highly saturated colors.

In order for ink-jet prints to effectively compete with silver halide photography prints, one important improvement that must occur is that ink-jet images must retain their image properties over longer periods of time. In other words, enhanced permanence of images has become important to the long-term success of photo-quality ink-jet ink technologies. At this point in time, photographs typically will last much longer under prolonged light exposure, i.e., about 14–18 years under fluorescent light exposure. Conversely, some of the best ink-jet printers will produce prints that last for only about 6–8 years under similar conditions. Particularly, with respect to dye-based ink-jet ink, the phenomenon of discoloration occurs even more readily than is typical for pigment-based ink-jet inks. However, as described above, dye-based inks are sometimes preferred because they are very convenient to use and have good distinction of color. One solution used to improve the longevity of ink-jet ink-produced images is the use of overcoats. However, improvement in the overcoating area is needed.

SUMMARY OF THE INVENTION

It has been recognized that it would be advantageous to develop a system for protecting images printed on porous media, such as by using a thermal overcoat having certain properties. As such, the present invention provides a layered sheets for providing thermal transfer overcoats, methods of applying a thermal transfer overcoat, thermally overcoated digitally-created prints on porous media, and systems for overcoating printed images printed on porous media.

In accordance with a more detailed aspect of the present invention, a layered sheet for application of a thermal coating to an image printed on porous media substrate can include three or more layers. One layer can be an adhesive protective layer configured for flowing when the layered sheet is heated to an application temperature. Another layer can include a carrier ribbon configured for carrying the adhesive protective layer, wherein the carrier ribbon has a phase transition temperature (Tp) that is at least 20° C. greater than that of the adhesive protective layer, and a coefficient of thermal expansion at the application temperature of less than 500 $\mu$m/m/° C., such that when the layered sheet is heated to the application temperature, the carrier ribbon substantially maintains its form. Next, a release layer adhered between the adhesive protective layer and the carrier ribbon can be present. The release layer can have a phase transition temperature (Tp) that is at least 2° C. greater than the adhesive protective layer, and is less than the phase transition temperature of the carrier ribbon. The release layer can also be configured such that when the layered sheet is heated to the application temperature and the adhesive protective layer is applied to a porous media substrate, the adhesion force between the porous media substrate and the adhesive protective layer is greater than the adhesion force provided by the release layer.

In another detailed aspect, a method of thermally overcoating a digitally printed image without leaving unwanted tags can comprise a multiple step process. Steps can include providing an image printed on a porous media substrate, as well as providing a layered coating sheet comprising a carrier ribbon, a release layer, and an adhesive protective layer. The phase transition temperature of the adhesive protective layer can be at least 2° C. less than that of the release layer, and the phase transition temperature of the carrier ribbon can be greater than that of the release layer. An additional step includes heating the layered coating sheet to a temperature below the phase transition temperature (Tp) of the carrier ribbon so that the carrier ribbon substantially maintains its form, and the temperature is at or above the phase transition temperature (Tp) of the release layer and the adhesive protective layer. With this arrangement, the adhesive protective layer can become softened upon heating to a temperature that is above the phase transition temperature (Tp) of the adhesive material, thereby rendering the adhesive protective layer flowable. Upon heating, the step of contacting the adhesive protective layer with the porous media substrate can occur. Further, the step of separating the carrier ribbon from the adhesive protective layer when the adhesion force between the porous media substrate and the adhesive protective layer is greater than the adhesion force provided by the release layer to the carrier ribbon can be carried out. Such a method can provide a thermal overcoat that fills voids within the porous media substrate and is substantially free of tags, even without an added tag-cutting step.

In another embodiment, a thermally coated print can comprise a porous media substrate having printed thereon a digitally produced image, wherein the digitally produced image and the porous media substrate is thermally coated by an adhesive protective layer. The adhesive protective layer can have a loss tangent (tangent d) that is greater than 1 and a melt viscosity of less than $1\times10^5$ Pa·sec. at the application temperature. Designed such, the layer can be applied as it is brought above its phase transition temperature, such that voids in the porous media substrate are substantially filled, and such that substantially no tags remain on the print, even in the absence of an additional cutting step.

In accordance with another embodiment, a system for thermally overcoating digital images printed on porous media can comprise a printed image on a porous media substrate, a layered sheet comprising the thermal coating layer, and a heat source for applying the thermal coating. The layered sheet for application of a thermal coating to the image printed on the porous media substrate can comprise a carrier ribbon, a release layer applied to the carrier ribbon, and an adhesive protective layer having a loss tangent (tangent d) that is greater than 1 and a melt viscosity of less than $1\times10^5$ Pa.·sec. at the application temperatures applied to the overcoat material. Additionally, the heat source can be thermally coupled to the layered sheet, wherein upon application of heat to the layered sheet, pressured contact between the adhesive protective layer and the porous media substrate, and separation of the adhesive protective layer form the carrier ribbon, adhesion and separation can occur. For example, it is desired that the adhesion force between the porous media substrate and the adhesive protective layer is greater than the adhesion force provided by the release layer, thereby providing a thermal overcoat that fills voids within the porous media substrate and is substantially free of tags.

Additional features and advantages of the invention will be apparent from the detailed description which follows, taken in conjunction with the accompanying drawings, which together illustrate, by way of example, features of the invention.

DETAILED DESCRIPTION OF THE INVENTION

Figure 1:
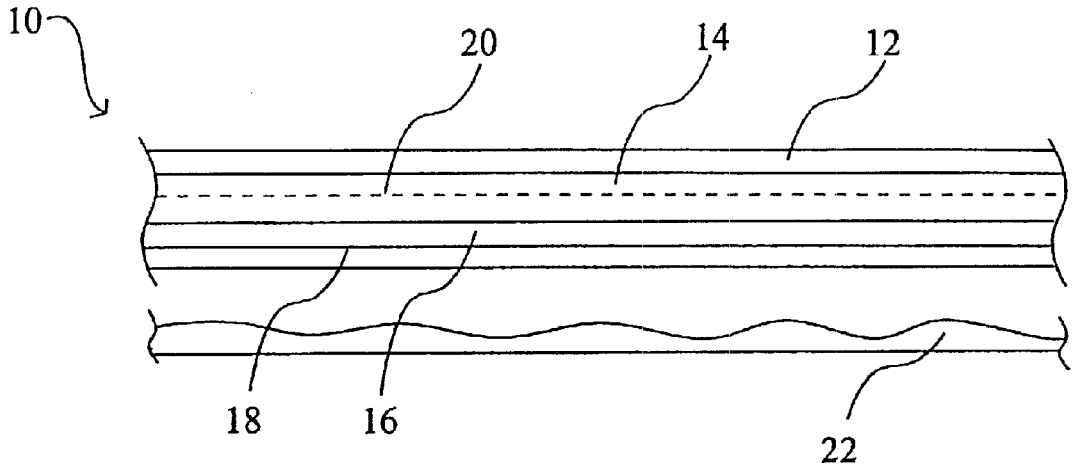
FIG. 1 is a cross-sectional view of a layered sheet system for application of an adhesive protective layer to a porous media print in accordance with an embodiment of the present invention.

Before the present invention is disclosed and described, it is to be understood that this invention is not limited to the particular process steps and materials disclosed herein because such process steps and materials may vary somewhat. It is also to be understood that the terminology used herein is used for the purpose of describing particular embodiments only. The terms are not intended to be limiting because the scope of the present invention is intended to be limited only by the appended claims and equivalents thereof.

It must be noted that, as used in this specification and the appended claims, the singular forms "a," "an," and "the" include plural referents unless the content clearly dictates otherwise.

"Tags" refers to pieces of overcoating material that extend over the edge of a media sheet after undergoing an overcoating process. In the prior art, tags have often been cut off using a separate cutting step.

"Tangent d" or "the loss tangent" is a convenient measurement of viscoelastic function comparing the ratio of energy lost to energy stored in a cyclic deformation, or can be a measure of elastic loss or heat dissipation. More dilute polymeric solutions tend to have large loss tangent values, including many that are greater than 1. Amorphous polymers, whether cross-linked or not, have values in a transition zone which are in the neighborhood of about 1, and typically ranging from about 0.2 to 3. Crystalline polymers tend to have low loss tangent values, typically less than about 1. The loss tangent determines such macroscopic physical properties as the damping of free vibrations, the attenuation of propagated waves, and the frequency width of a resonance response.

"Melt viscosity" refers to a measure of internal friction within a liquid or semi-solid, typically under application of heat and at temperatures just before or above the phase transition temperature. It manifests itself as a resistance to the material changing shape, or to the movement of adjacent planes of the material relative to one another.

"Coefficient of thermal expansion" refers to dimensional change of material per unit area at a certain temperature.

This applies to directions both perpendicular and parallel to the porous coated paper travel during the thermal transfer overcoating process. The values can be positive or negative.

When referring to a "print" or "printing," the use of ink-jet produced prints or printing, dry electrophotographic prints or printing, or wet electrophotographic prints or printing are preferred. Most preferred is the use of ink-jet produced prints or printing processes.

Reference will now be made to the exemplary embodiments illustrated in the drawings, and specific language will be used herein to describe the same. It will nevertheless be understood that no limitation of the scope of the invention is thereby intended. Alterations and further modifications of the inventive features illustrated herein, and additional applications of the principles of the inventions as illustrated herein, which would occur to one skilled in the relevant art and having possession of this disclosure, are to be considered within the scope of the invention.

As illustrated in FIG. 1, a system, indicated generally at 10, in accordance with the present invention is shown for applying a thermal overcoat to a porous media substrate. A carrier ribbon 12 is used to carry a release layer 14 that is configured to soften at a desired temperature. The release layer 14 carries a protective layer 16 which will ultimately protect an image printed on porous media 22. The protective layer carries an adhesive layer 18 that is configured to thermally adhere to the porous media 22 upon heating and contact. In one embodiment, a heat source (not shown) is thermally coupled to the carrier ribbon 12 such that heat is transferred through the carrier ribbon 12, to the release layer 14, to the protective layer 16, and to the adhesive layer 18. Upon application of the coating to the porous media substrate 22, the release layer 14 can separate at a separation plane 20.

In accordance with another aspect of the present invention, the system 10 can be modified as is needed for a specific application. For example, though the protective layer 16 and the adhesive layer 18 are shown as two distinct layers, in one embodiment, the protective layer can comprise adhesive characteristics such that a single adhesive protective layer is present.

Figure 2:
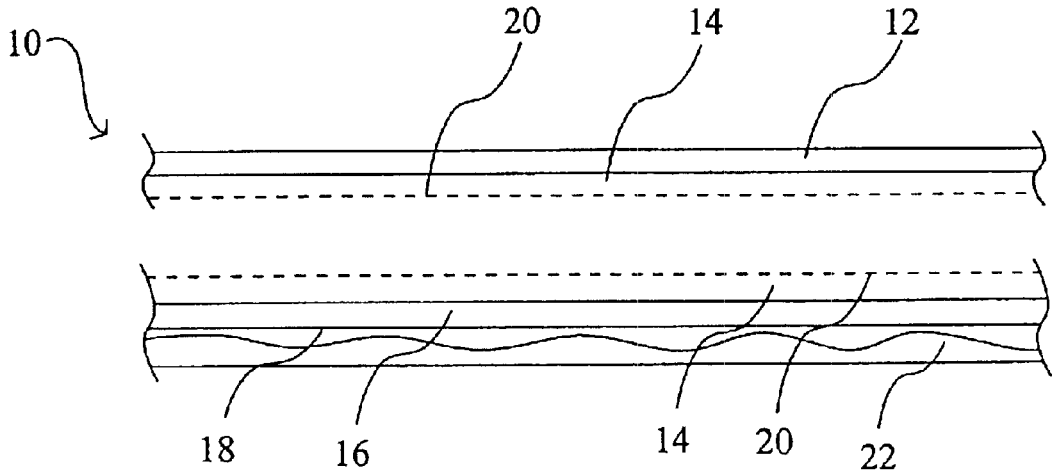
FIG. 2 is a cross-sectional view of the layered sheet system of FIG. 1 after release layer separation and porous media substrate adhesion.

As illustrated in FIG. 2, the release layer 14 is shown as separated along a separation plane 20 such that the protective layer 16 and the adhesive layer 18 are pulled away from the carrier ribbon 12. As the adhesive layer 18 thermally overcoats the porous substrate 22, gaps and voids of the porous substrate are substantially filled. Additionally, as the adhesion force between the porous media 22 and the adhesive layer 18 is greater than the force holding the release layer 14 to the carrier ribbon 12, upon contact between the adhesion layer 18 and the porous media 22, the release layer 14 splits along the separation plane 20 as shown. Though the release layer is shown as split, it can also be separated from the adhesive protective layer or the carrier ribbon along its boundary. Therefore, it is not merely the softening of the release layer that enables the coating to transfer, but a combination of softening of the release layer 14 along with a pulling force created by the adhesion between the porous substrate 22 and the adhesive layer 18 that promotes the depositing of the coating.

The thermal transfer overcoat, which can include both the adhesive layer 18 and the protective layer 16, can be applied according to the above principles where the phase transition temperature (Tp) of the adhesive layer 18 next to the porous substrate 22 is at least 2° C. less than that of the release layer 14 next to the carrier ribbon 12. In further detail, this can occur while both the phase transition temperature (Tp) of the adhesive layer 18 and release layer 14 is below that of the carrier ribbon 12. The phase transition temperature (Tp) of the protective layer (if a separate layer from the adhesive layer) can be of any functional value, though often, it will be similar to that of the adhesive layer.

Figure 3:
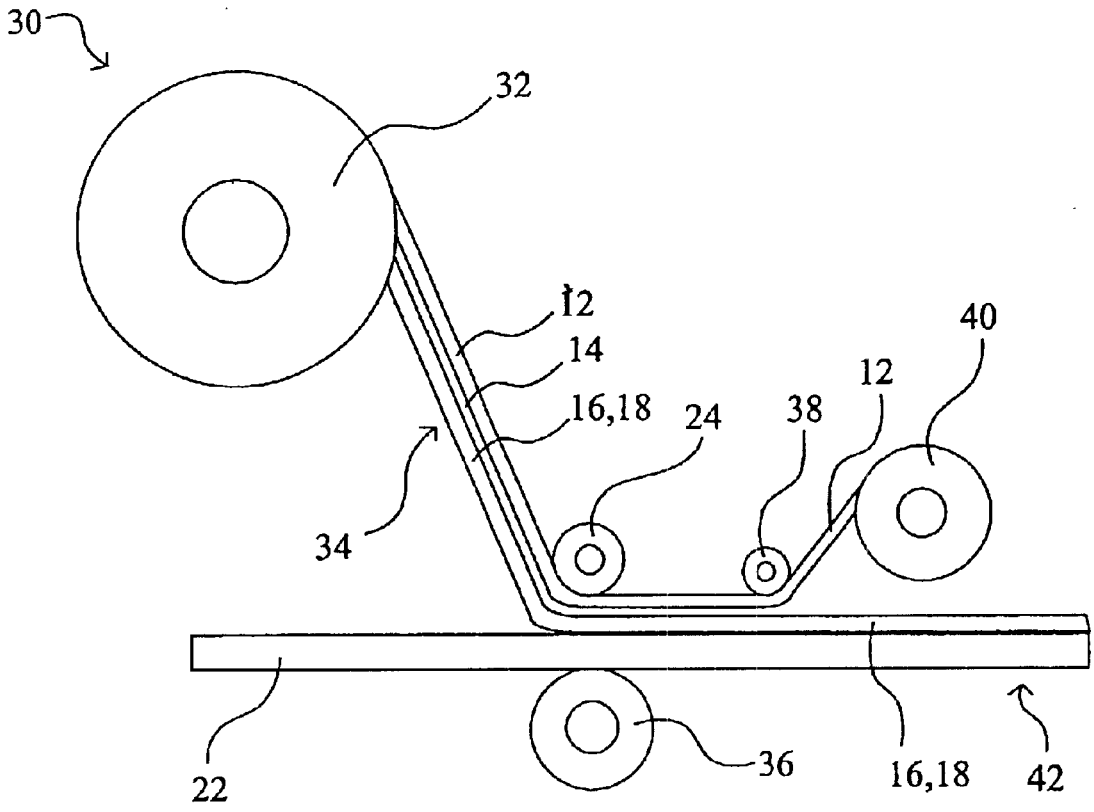
FIG. 3 is a schematic representation of an embodiment of a system of the present invention.

Turning to FIG. 3, a system 30 is shown that can apply a thermal transfer overcoat in accordance with an embodiment of the present invention. Specifically, a supply roll 32 acts to supply the layered sheet material 34 that is used for coating a porous media substrate 22. The layered sheet material 34 comprises at least three layers, including a carrier ribbon 12, a release layer 14, and an adhesive protective layer 16, 18. The adhesive protective layer 16, 18 can be a single polymeric material, or can be two or more separate layers, e.g., an adhesive layer and a protective layer. A heating element 24 is present in the form of a roller. Opposite the heating element 24 is a pressure roller 36. As the porous media substrate 22 (having an image printed thereon) and the layered sheet material 34 pass between the heating element 24 and the pressure roller 36, the layered sheet material 34 is heated to an application temperature, and becomes subject to a predetermined pressure. In one embodiment, the pressure can be above about 100 psi and the temperature can be above about 120° C. Of course, optimizing these values depends on the materials used, and the relative phase transition temperatures (Tp) and the loss tangent of the materials used in the layered sheet material composite. A separator bar 38 acts to remove the carrier ribbon 12 from the adhesive protective layer 16, 18. The carrier ribbon 12 is collected in a take-up roll 40, and the adhesive protective layer 16, 18 is adhered to the porous media substrate 22 to form a thermally coated porous media substrate 42. With this system, thermal transfer overcoats can be applied to porous media substrates that are much thinner at a much faster rate than standard laminate overcoat processes can provide.

It is to be understood that the above-referenced arrangements are only illustrative of an application of the principles of the present invention. Numerous modifications and alternative arrangements can be devised without departing from the spirit and scope of the present invention while the present invention has been shown in the drawings and fully described above with particularity and detail in connection with what is presently deemed to be the most practical and preferred embodiment(s) of the invention, it will be apparent to those of ordinary skill in the art that numerous modifications can be made without departing from the principles and concepts of the invention as set forth in the claims.

With these figures as an exemplary reference, a layered sheet for application of a thermal coating to an image printed on porous media substrate can comprise three or more individual layers. One layer can be an adhesive protective layer configured for flowing when the layered sheet is heated to an application temperature. A second layer can be a carrier ribbon configured for carrying the adhesive protective layer. The carrier ribbon can be configured with a phase transition temperature (Tp) that is at least 20° C. greater than that of the adhesive protective layer and a coefficient of thermal expansion at the application temperature of less than 500 $\mu$m/m/° C., such that when the layered sheet is heated to the application temperature, the carrier ribbon substantially maintains its form. Next, a release layer can be adhered between the adhesive protective layer and the carrier ribbon, wherein the release layer has a phase transition temperature (Tp) that is at least 2° C. greater than the adhesive protective layer. Additionally, the release layer can also be configured such that when the layered sheet is heated to the application temperature and the adhesive protective layer is applied to a porous media substrate, the adhesion force between the porous media substrate and the adhesive protective layer is greater than the adhesion force provided by the release layer.

In one embodiment, upon heating the layered sheet to an application temperature, the adhesive protective layer can become flowing such that it fills voids within the porous media substrate. Additionally, the layered sheet can be configured such that upon heating the layered sheet to the application temperature and separating the carrier ribbon from the adhesive protective layer, a thermal coating remains on the porous media substrate that is substantially free of tags. The application temperature can be from 80° C. to 200° C., though this is dependent on the materials chosen for use, the speed of transport through the heater, and the system used to apply the thermal transfer overcoat. In some embodiments, it may be desirable to prepare the layered sheet such that a component of pressure aids in the application of the thermal transfer overcoat. As such, the layered sheet can be configured such that the application of a predetermined amount of pressure improves the application of the thermal coating to the porous media substrate. Appropriate amounts of pressure can vary, depending on the system, but can be from about 20 psi to 200 psi.

Though the adhesive protective layer can be described as a single layer, in some embodiments, it may be desirable to provide a multiple layered adhesive protective layer, which may include a separate adhesive layer and a separate protective layer.

Another characteristic of the adhesive protective layer that can be useful in preparing the layered sheet for a specific application is the loss tangent value. Preferably, the adhesive protective layer will comprise a material having a loss tangent (tangent d) value greater than 1 at the application temperature. As defined above in greater detail, the loss tangent is a ratio of energy lost to energy stored in a cyclic deformation, or can be a measure of elastic loss or heat dissipation. In addition, another characteristic of the adhesive protective layer that can be useful in preparing the layered sheet for a specific application is the melt viscosity. Preferably, the adhesive protective layer will comprise a material having a melt viscosity less than $1\times10^5$ Pa.·sec. at the application temperature.

In an alternative embodiment, a method of thermally overcoating a printed image without leaving unwanted tags can comprise several steps, including the steps of providing an image printed on a porous media substrate, and the step of providing a layered coating sheet comprising a carrier ribbon, a release layer, and an adhesive protective layer. The phase transition temperature of the adhesive protective layer can be at least 2° C. less than that of the release layer. Additionally, the phase transition temperature of the carrier ribbon can be greater than that of the release layer. A step of heating the layered coating sheet to a temperature below the phase transition temperature (Tp) and coefficient of thermal expansion limits so that the carrier ribbon maintains its form can then be carried out. With this step, the temperature should be at or above the phase transition temperature (Tp) of release layer such that the release layer is softened, the temperature is above the phase transition temperature (Tp) of the adhesive protective layer. This will render the adhesive protective layer flowable. Upon contacting the adhesive protective layer with the porous media substrate, and separating the carrier ribbon from the adhesive protective layer, the transfer occurs. However, the separating step should occur when the adhesion force between the porous media substrate and the adhesive protective layer is greater than the adhesion force provided by the release layer, thereby providing a thermal overcoat that fills voids within the porous media substrate and is substantially free of tags.

The heating step can be carried out with a heating roller at temperatures from 80° C. to 200° C. Likewise, the contacting step can occur with the aid of pressure, such as at pressures from 20 psi to 200 psi. The heating step and the contacting step can occur substantially simultaneously, such as in an embodiment where the heating element also assist in providing pressure to the layered sheet. In an additional embodiment, the adhesive protective layer can comprise an adhesive layer that is separate from the protective layer. In further detail, the adhesive protective layer can be configured to have a loss tangent value that is greater than 1 and a melt viscosity of less than $1\times10^5$ Pa.·sec. at the application temperature. Once the adhesive protective coating is adhered to the porous media substrate, such as by filing voids that are present on the porous media substrate, the separating step can occur as the carrier ribbon is pulled away from the adhesive protective layer.

In another embodiment, a thermally coated print can comprise a porous media substrate having an image printed thereon. The image and the porous media substrate can then be thermally coated by an adhesive protective layer. The adhesive protective layer is applied as the adhesive protective layer is brought above its phase transition temperature where preferably has a loss tangent that is greater than 1 and the melt viscosity is less than $1\times10^5$ Pa.·sec. In this embodiment, voids in the porous media substrate can be substantially filled, and substantially no tags will remain on the print, even without an additional cutting step.

In one embodiment, the adhesive protective layer can comprise two or more individual layers, e.g., an adhesive layer and a protective layer. Thermally transferred overcoats of various thickness can be present on the coated prints of the present embodiment. For example, the adhesive layer can be from about 2 $\mu$m to 5 $\mu$m in thickness. In another embodiment, the protective layer can be from about 2 $\mu$m to 5 $\mu$m in thickness. With respect to the porous media substrate itself, any such substrate can be used, including a porous media substrate that includes a silica or alumina material.

In another embodiment, a system for thermally overcoating images printed on porous media can comprise an image printed on a porous media substrate, a layered sheet for application of a thermal coating to the image printed on the porous media substrate, and a heat source for applying the thermal coating. The layered sheet can include a carrier ribbon, a release layer applied to the carrier ribbon, and an adhesive protective layer having a loss tangent value that is greater than 1 and melt viscosity of less than $1\times10^5$ Pa.·sec. at the application temperature. The heat source can be thermally coupled to the layered sheet, wherein upon application of heat to the layered sheet, pressured contact between the adhesive protective layer and the porous media substrate, and separation of the adhesive protective layer form the carrier ribbon, good adhesion and separation can be effectuated. For example, the system can be configured such that the adhesion force between the porous media substrate and the adhesive protective layer is greater than the adhesion force provided by the release layer, thereby providing a thermal overcoat that fills voids within the porous media substrate and is substantially free of tags.

With respect to each of the above embodiments, a porous media print overcoat film, e.g., adhesive layer and protective layer, has needed to have the properties of good coverage over the printed sheet, while at the same time avoiding extra material extending over the edge of the sheet, e.g., tags. When a fuser application and a peeling separation system is used for a thermal transfer protective overcoat, it has been found that the properties cited above can be obtained by a design where each layer has specific melt characteristics. In addition, it has also been found that the phase transition temperature (Tp) of the adhesive layer and the protective layer (or a single combination layer) must be below the application temperature. However, the adhesive layer should be able to flow for good adhesion to the media substrate, as well as for filling pores of the media substrate. The release layer should also have a viscosity low enough so that the overcoat can deform with the substrate roughness.

It is not the purpose of the present invention to describe the physical properties of each layer as can be used in every possible combination. It is also not the purpose of the present invention to describe why good adhesion can be achieved without undesired tags. However, it is believed that such properties are achieved for a few reasons that contribute to the relative adhesion of the release layer at the point where the carrier ribbon is separated from the image substrate. First, the release layer is physically closer to the heat source resulting in higher exit temperature in the release layer relative to the adhesive layer. As a consequence, recovery of adhesive properties between the release layer and the carrier ribbon takes longer relative to the adhesive-substrate interaction where the adhesive layer exits the heat source at a lower temperature. Next, the adhesive layer next to the substrate loses heat more quickly as it is cooled by the imaged substrate acting as a heat sink. Additionally, the adhesive needs to flow to adhere to the substrate. This flow behavior benefits from a lower phase transition temperature (Tp). In other words, at a certain temperature, a lower phase transition temperature will have higher adhesive properties.

In one embodiment, a print created on a porous coating that is subsequently protected by a thermal transfer overcoat can be configured such that an image printed on the porous substrate can have about a 60° gloss of greater than 20%. In another embodiment, it has been recognized that the design of the thermo-mechanical properties of the protective overcoat adhesive has a large effect on the processability and quality of the final result. In particular, the porous nature of the substrate to be coated results in many voids that the overcoat adhesive is forced to flow into to achieve good bonding between the print and the overcoat. It has further been recognized that by controlling the ratio of the adhesive viscous modulus and elastic modulus (the loss tangent) and the adhesive melt viscosity, good flow of the adhesive can be achieved and bonding can be maintained through the separation process. In particular, if the loss tangent is greater than about 1 and the melt viscosity is less than $1\times10^5$ Pa.·sec., then a flowable polymer can be more easily produced that provides properties desirable for use with the present invention. Conversely, if the loss tangent value is less than 1 and the melt viscosity is greater than $1\times10^5$ Pa.·sec. at the application temperature, a rubbery polymer is more likely to be present that has more of a tendency to not flow into the pores or pull back out of porous media substrate pores. Finally, the application temperature is limited by the phase transition temperature and the coefficient of thermal expansion of less than 500 $\mu$m/m/° C. of the carrier film.

There are many polymeric materials that can be used for the layered sheet of the present invention. For example, the carrier ribbon can include polymers selected from the group consisting of polyethylene terepthalate, polyester, polypropylene, and the like. The release layer can include materials such as acrylics with polyethylene fillers, alkyl vinyl ether-maleic anhydride copolymers, silicones, urea alkyds, vinyl ethers, polyester resins, and the like. The adhesive protective layer can be a single layer that provides the dual function of protecting an image from the environment and adhering to the porous media substrate under the proper conditions. However, if two separate layers are used, the protective layer can comprise materials such as cellulose esters, polyvinyl chloride, polyvinyl butyral, polyester resin, polystyrene resin, polyurethane resin, acrylic resins, phenol resins, isocyanates, epoxy resins, melamine resins, and copolymer or crosslinked forms of the above, to name a few. The adhesive layer can include materials such as polyurethane, polycaprolactone, acrylic polymers, acrylate polymers, polyvinyl acetate, celluloses, polyalkylenes, polystyrene, polyisobutylenes, acrylic, polyolefin, polyester, and copolymers and crosslinked forms thereof. Modification of the phase transition temperature (Tp) as prescribed herein can be accomplished by modification of the molecular weight, blending the polymers, and/or using plasticizers, all of which are known by those skilled in the art.

With respect to the porous coatings used for overcoating, many inorganic porous coatings could benefit from the systems and methods of the present invention. Porous coatings in general for use with ink-jet printers are well known, e.g., alumina or silica coatings. While these coatings have the benefits of good ink adsorption and color saturation, they suffer from degradation due to air components, e.g., oxygen, ozone, etc. Lamination of such images is one method available for protecting the color saturation. However, laminates that are often too thick and expensive to be pleasing and practical for typical photos, and require the extra processing step of cutting the edges, such as for tags. By application of a thin thermal transfer overcoat to an image printed on porous coated media, the printed image can be protected substantially from the damaging effects of air without the need for cutting tags or other laminate material from the edges. If the principles of the present invention are properly followed, tags are removed naturally as the release layer is pulled apart as described herein.

Specifically, when a fuser application and peeling separation system is used for thermal transfer protective overcoating, the release layer (layer closest to a temporary carrier ribbon layer) needs to release when a force is applied to it at the peel section by adhesion to the substrate. However, there should be a strong adherence between the release layer and the carrier ribbon in areas where there is not an adhesive force to the substrate. The adhesive layer (next to the substrate) needs to flow in the fuser nip or heating area to form an adhesive bond (prior to separation) that is stronger than the adhesive force of the release layer to the temporary carrier ribbon.

Thermal transfer overcoats prepared in accordance with embodiments of the present invention can be favorably compared with laminate overcoats in several areas. For example, thermal transfer overcoats can be applied at a much thinner profile than typical laminates, e.g., 2 $\mu$m to 10 $\mu$m for thermal transfer overcoats compared to 20 $\mu$m to 125 $\mu$m for laminates. Additionally, thermal transfer overcoats prepared in accordance with embodiments of the present invention are typically more flexible, provide a non-continuous transfer that partially melts into pores reducing visible stress and curl, do not require trimming, and are less expensive to prepare than typical laminate overcoat systems.

While the invention has been described with reference to certain preferred embodiments, those skilled in the art will appreciate that various modifications, changes, omissions, and substitutions can be made without departing from the spirit of the invention. It is therefore intended that the invention be limited only by the scope of the appended claims.

What is claimed is:

1. A layered sheet for application of a thermal coating to an image printed on porous media substrate, comprising:

(a) an adhesive protective layer configured for flowing when the layered sheet is heated to an application temperature;

(b) a carrier ribbon configured for carrying the adhesive protective layer, said carrier ribbon having a phase transition temperature (Tp) that is at least 20° C. greater than that of the adhesive protective layer, such that when the layered sheet is heated to the application temperature, the carrier ribbon has a coefficient of thermal expansion of less than 500 $\mu$m/m/° C. and substantially maintains its form; and (c) a release layer adhered between the adhesive protective layer and the carrier ribbon, wherein the release layer has a phase transition temperature (Tp) that is at least 2° C. greater than the adhesive protective layer, said release layer configured such that when the layered sheet is heated to the application temperature and the adhesive protective layer is applied to a porous media substrate, a first adhesion force between the porous media substrate and the adhesive protective layer is greater than a second adhesion force provided by the release layer.

2. A layered sheet as in claim 1, wherein upon heating the layered sheet to the application temperature, the adhesive protective layer becomes flowing such that it fills voids within the porous media substrate upon contact with the porous media substrate.

3. A layered sheet as in claim 1, wherein the layered sheet is configured such that upon heating the layered sheet to the application temperature and separating the carrier ribbon from the adhesive protective layer, a thermal coating remains on the porous media substrate that is substantially free of tags.

4. A layered sheet as in claim 3, wherein the application temperature is from 80° C. to 200° C.

5. A layered sheet as in claim 3, wherein the layered sheet is configured such that the application of pressure improves application of the thermal coating to the porous media substrate.

6. A layered sheet as in claim 5, wherein the pressure applied is from 20 psi to 200 psi.

7. A layered sheet as in claim 1 wherein the adhesive protective layer comprises an adhesive layer and a protective layer.

8. A layered sheet as in claim 1, wherein the adhesive protective layer comprises a material having a loss tangent value greater than 1 at the application temperature.

9. A layered sheet as in claim 1, wherein the adhesive protective layer comprises a material having a melt viscosity less than $1\times10^5$ Pa.·sec. at the application temperature.

10. A method of thermally overcoating a printed image without leaving unwanted tags, comprising:

(a) providing a porous media substrate having an image printed thereon;

(b) providing a layered coating sheet comprising a carrier ribbon, a release layer, and an adhesive protective layer, wherein the phase transition temperature of the adhesive protective layer is at least 2° C. less than that of the release layer, and wherein the phase transition temperature of the carrier ribbon is greater than the that of the release layer; and (c) heating the layered coating sheet to an application temperature below the phase transition temperature (Tp) of the carrier ribbon so that the carrier ribbon maintains its form, said application temperature being at or above the phase transition temperature (Tp) of release layer such that the release layer is softened, said application temperature being above the phase transition temperature (Tp) of the adhesive protective layer rendering the adhesive protective layer flowable;

(d) contacting the adhesive protective layer with the porous media substrate; and (e) separating the carrier ribbon from the adhesive protective layer when the adhesion force between the porous media substrate and the adhesive protective layer is greater than the adhesion force provided by the release layer, thereby providing a thermal overcoat that fills voids within the porous media substrate and is substantially free of tags.

11. A method as in claim 10, wherein the adhesive protective layer comprises an adhesive layer and a protective layer.

12. A method as in claim 10, wherein the adhesive protective layer has a loss tangent value that is greater than 1 at the application temperature.

13. A method as in claim 10, wherein the adhesive protective layer comprises a material having a melt viscosity less than $1\times10^5$ Pa.·sec. at the application temperature.

14. A method as in claim 10, wherein the heating step is by a heating roller.

15. A method as in claim 10, wherein the contacting step occurs under pressure.

16. A method as in claim 15, wherein the temperature is from 80° C. to 200° C., and the pressure is from 20 psi to 200 psi.

17. A method as in claim 10, wherein the contacting step and the heating step occur substantially simultaneously.

18. A method as in claim 10, wherein the separating step occurs as the carrier ribbon is pulled away from the adhesive protective layer after the adhesive protective layer has filled voids on the porous media substrate.

19. A thermally coated print, comprising a porous media substrate having printed thereon a digitally produced image, said digitally produced image and said porous media substrate being thermally coated by an adhesive protective layer, said adhesive protective layer having a tangent d that is greater than 1 and melt viscosity less than $1\times10^5$ Pa.·sec. as applied above its phase transition temperature, such that voids in the porous media substrate are substantially filled, and such that substantially no tags remain on the print in the absence of an additional cutting step.

20. A system as in claim 19, wherein the adhesive protective layer comprises an adhesive layer and a protective layer, said adhesive layer positioned between the protective layer and the porous media substrate.

21. A system as in claim 19, wherein the adhesive layer is from about 3 $\mu$m to 10 $\mu$m in thickness.

22. A system as in claim 20, wherein the adhesive layer is from about 2 to 5 $\mu$m in thickness and the protective layer is from about 2 $\mu$m to 5 $\mu$m in thickness.

23. A system as in claim 19, wherein the porous media substrate comprises a member selected from the group consisting of silica and alumina.

24. A system for thermally overcoating an image printed on porous media, comprising:

(a) a porous media substrate having an image printed thereon;

(b) a layered sheet for application of a thermal coating to the image on the porous media substrate, said layered sheet comprising:

(i) a carrier ribbon, (ii) a release layer applied to the carrier ribbon, and (iii) an adhesive protective layer that is applied with a tangent d greater than 1 and a melt viscosity less than $1\times10^5$ Pa.·sec. applied to the release layer; and (c) a heat source thermally coupled to the layered sheet, wherein upon (i) application of heat to the layered sheet, (ii) pressured contact between the adhesive protective layer and the porous media substrate, and (iii) separation of the adhesive protective layer form the carrier ribbon, the adhesion force between the porous media substrate and the adhesive protective layer is greater than the adhesion force provided by the release layer, thereby providing a thermal overcoat that fills voids within the porous media substrate and is substantially free of tags.

* * * * *

UNITED STATES PATENT AND TRADEMARK OFFICE

CERTIFICATE OF CORRECTION

PATENT NO. : 6,869,650 B2
DATED : March 22, 2005
INVENTOR(S) : Burch et al.

It is certified that error appears in the above-identified patent and that said Letters Patent is hereby corrected as shown below:

Column 12,
Line 1, after "than", delete "the".

Signed and Sealed this

Tenth Day of January, 2006

JON W. DUDAS
*Director of the United States Patent and Trademark Office*